US010232636B2

(12) United States Patent
Martins Pinto

(10) Patent No.: US 10,232,636 B2
(45) Date of Patent: Mar. 19, 2019

(54) DIGITAL PRINTING PROCESS OF A VEHICLE BODY

(71) Applicant: VOLKSWAGEN DE MEXICO S.A. DE C.V., Cuautlacingo Puebla (MX)

(72) Inventor: Antonio Jose Martins Pinto, Setubal (PT)

(73) Assignee: VOLKSWAGEN DE MEXICO S.A. DE C.V., Puebla (MX)

( * ) Notice: Subject to any disclaimer, the term of this patent is extended or adjusted under 35 U.S.C. 154(b) by 0 days.

(21) Appl. No.: 15/326,596

(22) PCT Filed: Jun. 27, 2016

(86) PCT No.: PCT/MX2016/050008
§ 371 (c)(1),
(2) Date: Jan. 16, 2017

(87) PCT Pub. No.: WO2017/003277
PCT Pub. Date: Jan. 5, 2017

(65) Prior Publication Data

US 2017/0203580 A1 Jul. 20, 2017

(30) Foreign Application Priority Data

Jul. 1, 2015 (MX) ..... MX/a/2015/008613

(51) Int. Cl.
*B05B 3/00* (2006.01)
*B41J 3/407* (2006.01)
*B05B 13/04* (2006.01)

(52) U.S. Cl.
CPC ..... *B41J 3/4073* (2013.01); *B05B 3/00* (2013.01); *B05B 13/0452* (2013.01); *B05B 13/0457* (2013.01)

(58) Field of Classification Search
CPC ..... B41J 3/4073; B05B 13/0452; B05B 13/0431; B05B 3/00; B05C 11/1005; B41F 17/006
See application file for complete search history.

(56) References Cited

U.S. PATENT DOCUMENTS 4,498,414 A 2/1985 Kiba et al.
4,539,932 A * 9/1985 Vecellio ..... B05B 5/04 118/622

(Continued)

FOREIGN PATENT DOCUMENTS

EP 2196267 A2 6/2010
WO 2013143659 A1 10/2013

OTHER PUBLICATIONS

Introducción Al Proceso De Pintado De Vehículos. Mapfre 2012; http://www.mapfre.com/ccm/content/documentos/cesvimap/ficheros/CFPreparacionSuperficiesEXTRACTO.pdf; 11 Pages.

*Primary Examiner* — John Zimmermann
(74) *Attorney, Agent, or Firm* — Renner Kenner Greive Bobak Taylor & Weber

(57) ABSTRACT

The present invention relates to a painting process whose purpose is to carry out the printing of a digital image provided by a user to a vehicle body through a production line. Printing is achieved through a print head, which injects automotive ink (solvent base/water base) as well as eco-solvent printer ink and UV ink. The print head is instructed to perform a variety of automated operations to develop body painting, through continuous path control. The print head is characterized by having an arm-like structure through which different tools or embossers can be used to make the impression, the head being able to make decisions based on the information coming from the image provided by the user.

6 Claims, 4 Drawing Sheets

(56) References Cited

U.S. PATENT DOCUMENTS 4,721,630 A * 1/1988 Takeo ..... B05B 13/0292 118/314
4,844,947 A * 7/1989 Kasner ..... B05D 5/06 101/35
4,864,966 A * 9/1989 Anderson ..... B05B 12/14 118/302
5,127,363 A * 7/1992 Nakamura ..... B05B 15/555 118/695
5,989,643 A * 11/1999 Nakagawa ..... B05B 13/0452 118/313
7,350,890 B2 * 4/2008 Baird ..... B41J 3/4073 347/2
7,650,852 B2 * 1/2010 Clifford ..... B05B 13/0431 118/305
7,981,462 B2 * 7/2011 Bustgens ..... B05B 12/04 118/323
2004/0115360 A1 * 6/2004 Clifford ..... B05B 13/0431 427/8
2006/0190110 A1 * 8/2006 Holt ..... G06Q 10/06 700/96
2006/0292308 A1 * 12/2006 Clifford ..... B05B 12/149 427/427.2
2008/0020135 A1 * 1/2008 Fouvet ..... B05B 13/0292 427/181
2009/0320753 A1 * 12/2009 Yoshino ..... B05B 13/0431 118/315
2011/0262622 A1 * 10/2011 Herre ..... B05B 1/14 427/8
2013/0257984 A1 10/2013 Beier et al.
2014/0063096 A1 3/2014 Pitz et al.
2014/0069335 A1 * 3/2014 Bania ..... B05B 13/0452 118/696
2015/0042716 A1 2/2015 Beier et al.

* cited by examiner

DIGITAL PRINTING PROCESS OF A VEHICLE BODY

The present invention relates to a painting process whose purpose is to realize the printing of a digital image provided by a user to the body of a vehicle through a production line. Printing is achieved through a print head, which injects automotive ink (solvent base/water base) as well as eco-solvent printer ink and UV ink. The print head is instructed to perform a variety of automated operations to develop body painting, through continuous path control. The print head characterized by a structure shaped arm by which you can use different tools or apprehensors for printing, being capable head make decisions based on information from the image provided by the user.

BACKGROUND OF THE INVENTION

The evolution of automotive paint, from its beginnings, has been linked to the technical possibilities of the time and the requirements that customers have longed for the final product they are going to acquire.

The process of painting used in the first automobiles, was the same one that was used in the painting of carriages. The paints were prepared with resins and vegetable oils and were applied with a brush, the complete process of painting a car was concluded (due to the long drying time) in approximately four weeks.

With the arrival of the metallic body and the beginning of mass production in the first half of the twentieth century, it became technically necessary to achieve faster painting processes, with less drying time and that the paint was not exclusively black, then began the time of diversity in the painted ones of the automobiles.

The first paintings of the era of the series production were nitrocellulose, contributed by the chemical advances of the world-wide wars, which were applied with aerographic guns. Nitrocellulose paints were quick drying, but were not very weather resistant and had the drawback that over time they became cloudy.

By 1933, the most popular technique of painting car bodies was through aerographic guns which used synthetic paints based on alkyd resins, which with the same application technique (spray gun) achieved greater filling power and a glossy finish which did not need polishing, but only allowed the application of a single color.

These paintings were improved over the years to achieve very resistant films that could be baked at 120° C., thus shortening the times demanded drying.

In the 1960s, the era of effect paintings began. Another type of resin, acrylics, began to be used, developing in two different directions: thermoplastic acrylics and thermoplastics of two components. The latter hardened rapidly by baking to achieve a shiny and highly resistant finish. In the same decade of 1960, began to paint automobiles with so-called metallic paints, which included aluminum particles in their composition in order to satisfy the desire of customers to reproduce in the body a metallic effect. But effect paintings had drawbacks; the metal platelets were close to the surface causing them to oxidize and break off over time, creating problems in the duration and repair. Effect paints were one of the first examples in allowing the customization of bodies to customer's liking, such as the incorporation of fire effects, shadows, etc.

In the decades that followed, the labeling of vinyl that subsequently adhered to the vehicle body and the handcrafted labeling through the "tuning" method for use in automobile personalization appeared in the automotive industry.

Tuning Method

The tuning method, allows to change the appearance of a vehicle after acquiring it, basically means to customize according to the tastes of its owners. The method allows to make changes in the outside as interior of the car achieving its own originality. The main drawback of this method is that it cannot be realized in a series production.

The tuning is made up of three groups:

a. Interior Tuning: The application of several modifications to the various elements and components inside vehicle or also, the changing of these parts with new ones. You can observe the interior of automobiles truly impressive, bright colors, high quality pieces, tapestry for the steering wheel, etc.

b. Motor Tuning: It is perhaps the least extended since in many cases maybe the technical characteristics of the vehicle are changed. Among the modifications that do not vary the characteristics of the engine are: air filters, direct intake and suspension.

c. Tuning Exterior: It is the most widespread group and refers to applying airbrushing on the body. It is a craft technique of decoration for the exterior mainly that can be applied to the personalized car as part of the resources that make the vehicle really unique. To apply the colors to the surface, either flat or three-dimensional, the airbrush is used. The airbrush is the most important tool, which works like a paint gun with compressed air and the paint is expelled by its tip in a conical form. The paint is mixed with pressurized air and is sprayed on exiting so that it can be colored gently, diffusely and faintly. The paint is impregnated on the surface to be decorated depending on the exit angle of the airbrush.

However, labeling through the "tuning" method is considered handcrafted and cannot be applied to a series production, the cost being generally high by depending significantly on the prestige of the "artist" who will make the modifications.

Vinyl Labeling

The process is intended to cover the entire exposed exterior surface of the body to protect the surface and at the same time achieve a new texture, original and even unusual color. Vinyl tuning comes in different aspects included in carbon fiber and can be trimmed in many different ways.

An adhesive vinyl film preserves the original paint of the car and gives it a personalized look. This method is known as plotting because the film copies the entire contour of the vehicle's surface. However, when the adhesive vinyl film has been damaged by the time effect, the film must be replaced and it requires a maximum level of protection to maintain the exterior beauty of the body.

However, like the tuning method, the vinyl does not make a digital impression on a body.

Unlike the above-mentioned techniques, the invention of interest accomplishes the personalization of an automobile through the digital printing of an image provided by the user. In addition, automotive ink (solvent base/water base) as well as eco-solvent printer ink and UV ink, manages to increase the amount of solids in its formulation, thus reducing the proportion of diluents without affecting the characteristics of gloss and hardness that these paints require.

BRIEF DESCRIPTION OF THE DRAWINGS

Referring to FIG. 1, it is presented the schematization of the process of application of paint through the areas of application of paint such as:

1A) Application area of the interior body paint through robots,

1B) Exterior painting application zone with 3-axis translation robots and

1C) Application area for exterior body painting through robots, where the W and X robots are used to perform exterior painting applications, and the Y and Z robots are used to perform the custom digital painting process.

Figure 2:
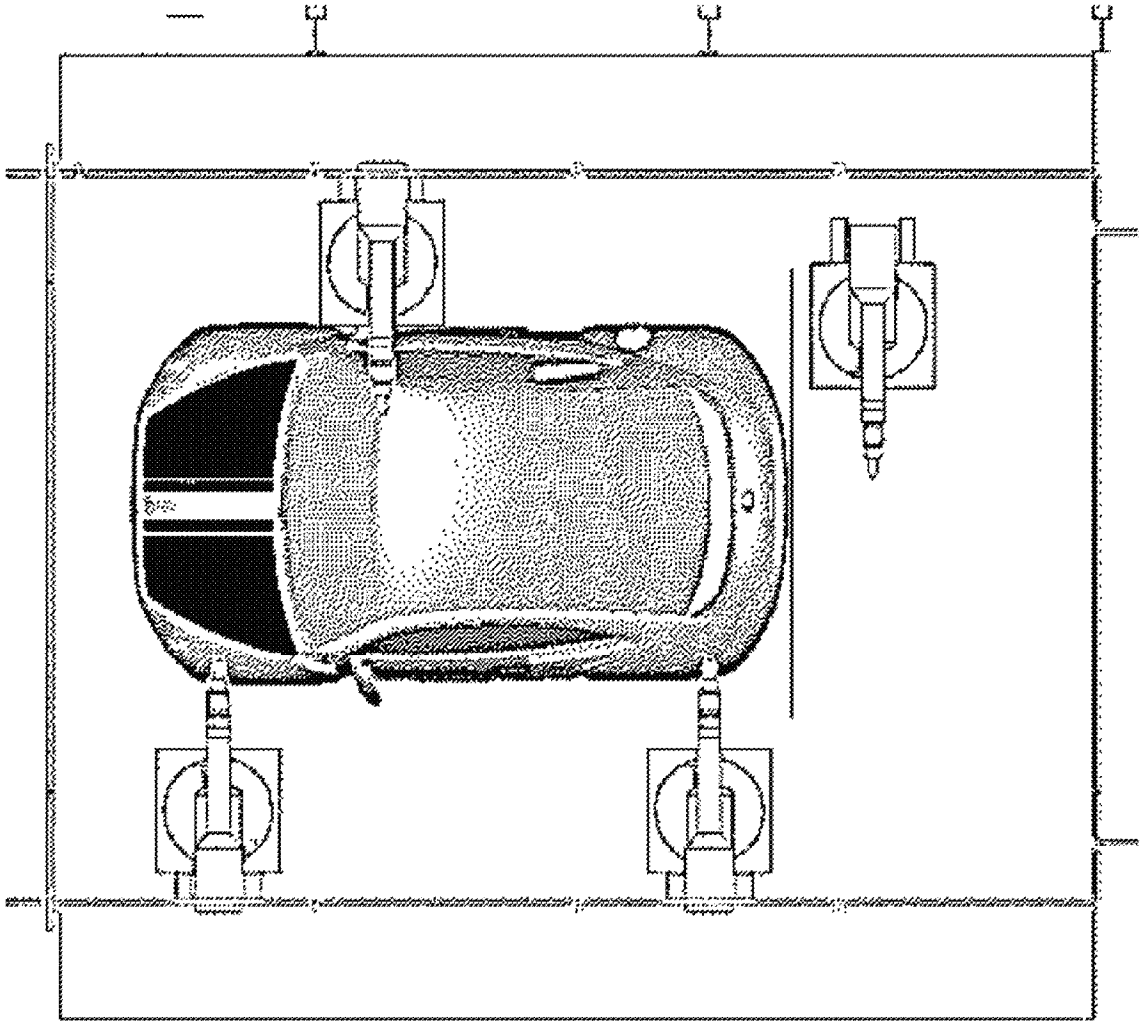
FIG. 2 Top view of an automated paint application booth.
Figure 3:
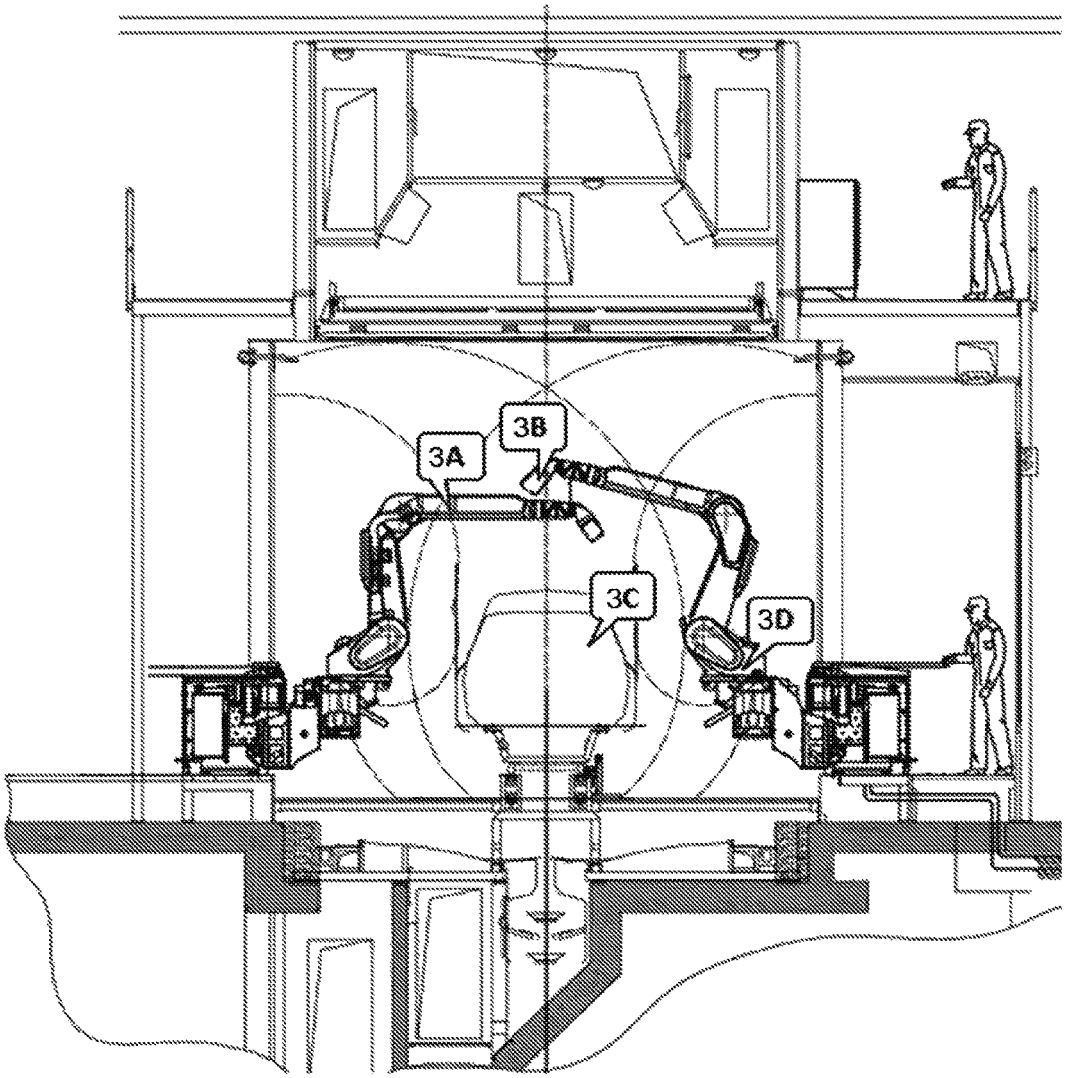
FIG. 3 Side cross-sectional view of an automated paint application booth.

FIG. 3 shows the realization of the digital paint application process on the body of a vehicle, FIGS. 2A and 2B, indicate the robots that apply the personalized digital printing on the body. FIG. 2C comprises the body on which the impression will be made and finally FIG. 2D shows the head that will realize the application of the digital impression of the image.

Figure 4:
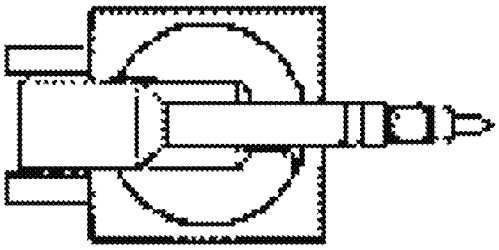
FIG. 4 Side cross view of a robot automated paint.

Referring to FIG. 4, it refers to a head of an automated paint robot which is capable of moving and autonomously executing various actions, following the parameters of the image chosen by the client. The articulations of the head allow it to act with degrees freedom by which paint is projected in all the hollows of the body.

DETAILED DESCRIPTION OF THE INVENTION

The object of the invention is to reproduce an image provided by a user in the body of a vehicle by digital printing using a recording head. The painting process can be done in manual, automatic and mixed phase.

The print head injects automotive ink (solvent base/water base) as well as eco-solvent printing ink and UV ink in a series production line, the head being able to apply different shades simultaneously. The design can be provided by the user or can be chosen from a database provided by the company.

The painting process of the invention involves various phases which include the application of a phosphate base to protect the corrosion, placement of primer to prepare the body, the application of the digital painting and successively reaches the final part consisting of the Application of the varnish. Said process can be used to be applied in a unit to an indeterminate number of units as required by the customer.

The painting process covers a double function. First, the vehicle is protected against corrosion and on the other hand it provides the final aesthetic appearance. The painting of the body of the cars is developed after the assembly and before beginning the assembly of the accessories and equipment.

During the body assembly process, surfaces can accumulate grease, dust and other impurities, which must be removed before moving to the paint area. Subsequently, the surfaces are prepared to ensure the perfect adhesion of the products to be deposited on them.

The painting process begins with the bodywork reception by the tinplate, which is processed through the phosphating and cataphoresis process (VBH/KTL), which performs a washing of impurities in the body sheet and the body. Prepares for adhesion of a first coat of paint.

Phosphating and cataphoresis (VBH/KTL) processes ensure that the contamination present in the bath is controlled and lowered to its minimum level. The objective of the surface treatment tunnel (VBH) is the degreasing and cleaning of the body before phosphating since a surface totally free of other substances is necessary before starting the painting process.

The first sub-process that the cab receives in the surface treatment tunnel is the spray degreasing. The objective of this process is to clean the bodies of the coating of oil, dirt and other impurities.

As a second step, a dip degreasing is performed. In this new phase, unlike spray degreasing, the body is submerged in ink, which contains an alkaline cleaner which can reach areas that by spray degreasing would be impossible. Subsequently, the surface conditioner is applied by immersion, where a dense layer of phosphate formed by fine crystals is formed, which is considered ideal as a base for painting.

Consequently, the phosphating phase begins, which adds a layer formed by phosphates of nickel, manganese phosphates and zinc to the body of the vehicle that provides the mechanical surface with anticorrosive properties. Phosphating is applied to prevent the infiltration of corrosion in the cataphoresis adhesive base (KTL). The phosphating process has as its mission the creation of a thin layer of oxide that is strongly adhered to the body, thus achieving a first protection against the progression of oxidation towards the interior, and a surface on which the next layer of paint adheres better.

The phosphating process is a treatment of conversion of the metal surface by immersion, by which the metal is attacked, forming a microcrystalline layer of zinc phosphate. The body is submerged in a bath composed mainly of phosphoric acid, primary zinc phosphates and accelerating additives, at temperatures between 40 and 60° C., for 90-180 seconds. This coating provides high corrosion resistance, plus high adhesion and durability. Also, a chemically inert surface is obtained, which prevents reactions between the metallic base and the various components of the paint.

The dipping provides a more uniform coating and better penetration into the hollow parts than through the spraying method. The layer created is porous and thanks to its crystalline structure, it increases the surface of contact facilitating the adhesion of the digital painting. The coating is virtually insoluble and electrically insulating, protecting the body against moisture and corrosion. Its thickness depends mainly on the immersion time and the total acidity of the bath, influencing other aspects such as temperature or agitation.

Subsequently, a spray rinse is carried out, which is necessary to remove as much fine sludge as possible from the phosphating step. As a complement, an immersion rinse is carried out, with the objective of eliminating the sludge that the previous stage by spray could not eliminate.

The next stage is immersion passivation, in which the vehicle body is immersed in a passivation vat, in order to increase the corrosion resistance of phosphated surfaces. Subsequently, a rinsing by immersion is carried out with demineralized or deionized recirculated water, in order to eliminate as much entrainment of residual salts as possible from the phosphating and passivation stages.

At the end of the phosphating process, the body of the vehicle is subjected to the body painting phase by cathodic electrodeposition or cataphoresis (KTL).

Cataphoresis consists of an immersion painting of vehicle bodies based on the phenomenon of electrophoresis whereby positively charged paint particles are displaced towards bodies that act as cathodes (negative charge) and are connected to a potential. The function of this second coating after phosphating is mainly anticorrosive.

The fundamental principle of cataphoresis is that materials with opposite electrical charges are attracted. Cataphoresis applies a direct current load to a metal part submerged in a paint bath with oppositely charged particles. The paint particles are attracted to the metal part and the paint is deposited in the metal part forming a uniform layer. The process continues on each surface in each slit and corner until the coverage reaches the desired thickness. Once the desired thickness is obtained, the layer isolates the piece and the attraction ceases, finishing the cataphoresis process.

During cataphoresis, the bodies from the surface treatment tunnel (TTS) are immersed in a stirred bath containing the lead-free, water-soluble cataphoretic paint.

In the cataphoresis bath area the paint is applied and the process control equipment is operated. The cataphoresis bath consists of 80%-90% deionized water and 10%-20% paint solids. The deionized water serves as the carrier of the paint solids, which are constantly agitated. Solids consist of resin and pigment. The resin is the main component of the final layer and provides corrosion resistance and durability. The pigments serve to provide color and shine. During this phase work in aqueous medium to avoid problems of contamination and flammability.

In the cataphoresis process, while the layer is deposited on the body, H+ are released at the anode. The way to maintain the equilibrium is to extract the excess of acetic acid that is formed, taking advantage of the migration of acetate ions (anions) towards the anodes (positive charge).

The body is then rinsed by spraying in order to remove solids, product of the paint bath, through the ultra-filtration system.

Subsequently, the body is rinsed with the objective of eliminating excess KTL and solids and immersing the body in a tub to clean the inside of it where the spray rinse is not able to reach. The body is then rinsed with demineralized water, first by immersion and then by spraying in order to remove as many solids as possible resulting from the application of dipping paint.

The body is then raised to the kilns and transported by a lateral drying ramp with nozzles on each side of the body. In this stage of bake, it is sought that the resin is deposited on the bodies.

At the end of the furnace stage, the body undergoes an application of a paste-like material called a seal which is applied to the lower parts, the engine compartment and the wheel case. This application allows to avoid corrosion by the environment and guarantees years of quality of the car body. Also, the seal aims to cover the assemblies and protect the body from blows, eliminate air and noise with the placement of insoles inside.

Subsequently, the cold process is carried out, in which the body passes through a furnace for drying or curing the hot air-based seal film.

Immediately after the sealing operations, a layer of paint called filler is applied to the body, which acts as a background to subsequently apply the color that is designated to the body. The purpose of the filler application is to level the surface of the body and serves as a second coat of paint.

The first phase of application of filler is the automatic application, where the body goes through some rollers with the aim of removing the surface of the dirt. The filler is then manually applied to the interior of the body by pneumatic pistols.

In order for the filler application to be adequate, certain parameters are taken into account to ensure the uniformity of the thickness in the filler layer, such as flow, voltage, bell revolutions and fan air.

At the end of the application of the painting called filler, a final washing of the body is carried out with deionized water in order to eliminate electrolytes and product residues from previous treatments.

Figure 1:
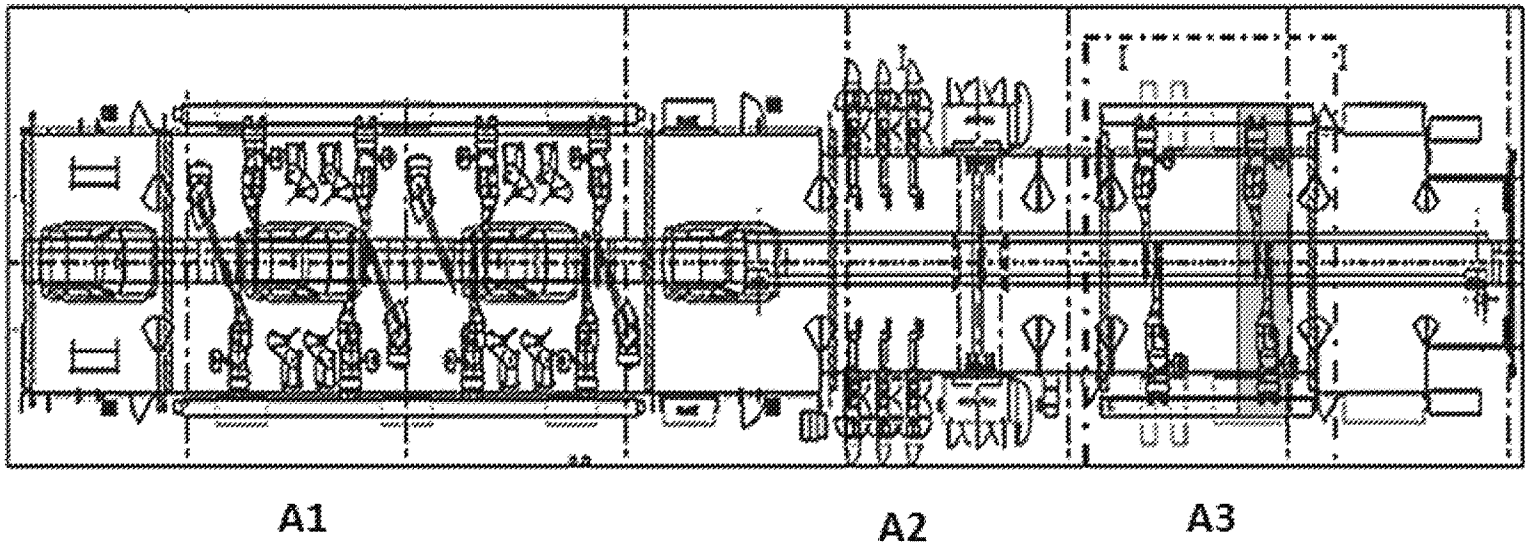
FIG. 1 Schematic top view of the paint application process.

The body then enters the automatic zones (DL) of the paint application process where the color is automatically applied by robots, as shown in FIG. 1.

The paint application process for the bodywork is done automatically using robots inside the paint application cell. The application cell is divided into an area of equipment intended to apply color to the body inside and another area that is responsible for performing the same operation but for the exterior of the body.

At the onset of this stage, it cleaning automatically provided to be applied paint base inside the body, as shown in FIG. 2, in the area of application of internal color bodies with robots (1A).

The indoor base application is automatically carried out in an automated paint spray booth as shown in FIG. 3, where the equipment covers the stirrups, interiors of doors and frames, as well as the interior of the hood and trunk lids.

Upon completion of the application of paint inside the vehicle body, the body is entered into the application zone with exterior color robots of 3 translation axes (1B) as shown in FIG. 1. The parameters to be monitored in this phase is the air pressure and the metal base flow.

Subsequently, the process of personalizing the body with robot printing is initiated through a special touch on the body whose area has already been designated and prepared to make the impression, as illustrated in FIG. 1, particularly in the area exterior color application robot body (1C). The first two robots perform exterior painting applications and the two remaining robots are used to carry out the digital paint application process.

The digital custom paint is printed by an electronically controlled mechanical robot head as exemplified in FIG. 4. The mechanical head is capable of moving and autonomously executing various actions, following the parameters of the chosen image for the client.

The head of the robot has joints that allow it to act with degrees freedom, so it projects paint in all the voids of the piece and has special protections as a defense to the suspended particles inside the paint booth and its possible consequences as explosions, fire, mechanical deterioration, etc.

Automatic robots, the application of the paint by electrostatic sprays, the operation of electrostatic sprayers is to generate a high rotation within its mechanism to break all the paint particles and generate a kind of cloud, which contains fine particles of Paintings that are deposited in the body by means of the movement of the robot to follow the silhouette of the body.

The sprayer generates an electric charge which is transferred through the application generating an electrostatic field that allows a better adhesion of the paint to the bodywork.

The mechanical robot head operates on the basis of a continuous path control, which specifies the start and end points of its movements, specifying the way forward.

The whole process of application by automatic robots is controlled by the PLC (Programmable Logic Controller) of the robot, which functions as a computer where the amount of paint, air pressure and electric charge necessary to apply the paint to the bodies. The Programmable Logic Controller also controls the movements that the robot must perform on the X, Y and Z axes to follow the figure of the car.

The application of paint on the bodies is done continuously, through a touch of line with which the body never remains static.

Being made auto printing ink (solvent based/water based) as well as eco-solvent ink and UV ink printer, drying is performed immediately. So the body then goes to the application of varnish that protects the color of the body against the environment and generates the shine that is desired in the car.

The touch time of the body with paint is 0.8 minutes to 1.2 minutes per vehicle unit.

After the varnish application, drying is carried out, usually lasting from 30 to 60 minutes at a temperature of 60° C. A final inspection will ensure that the finish does not present any defects.

This is why the painting process is achieved whose objective is to realize the printing of a digital image provided by a user to the body of a vehicle, through a production line.

The invention claimed is:

1. A process of painting and personalizing an image on a vehicle body during the painting application in manual, automatic and mixed phases within the assembly line comprising the steps of:

a. applying a phosphate base, cathodic electrodeposition painting, seal, filler to the vehicle body by at least one robot;

b. providing at least one other robot comprising a final line of print heads in the assembly line for digital printing of the image reproduced from an earlier image provided and personalized directly to the vehicle body, and c. carrying out digital printing of the image using automotive ink (solvent base/water base) such as eco-solvent printing ink and UV ink simultaneously with or immediately subsequent to application of the phosphate base, cathodic electrodeposition painting of the vehicle body, wherein the touch time for the painting and personalizing an image on the vehicle body during the paint application process that includes steps a., b., and c., is from 0.8 minutes to 1.2 minutes per unit; and d. drying the paint and the image on the vehicle body prior to varnishing.

2. The process of painting a vehicle body according to claim 1, which comprises two printing heads, which can use various types of automotive inks and apply different shades simultaneously.

3. The process of painting a vehicle body, according to claim 1, wherein the print head is characterized by:

having a robotic structure in the form of an arm through which different tools or structures are used to make the impression, containing a continuous path control that specifies the initial and final point of its movements specifying the way to follow in the body of the vehicle according to the drawing lines of the drawing to be printed, and moving and executing autonomously various actions on the X, Y and Z axes.

4. The process of painting a vehicle body, according to claim 1, wherein the image digitally reproduced is obtained is obtained from a database previously established by the owner or by the customer.

5. The process of painting a vehicle body in accordance with claim 4, wherein the image can be used from a vehicle unit to an indeterminate number of units as required by the customer.

6. The process of painting a vehicle body in accordance with claim 1, wherein a varnish finish is applied in the final step to protect the base paint and the printed design.

* * * * *